US005905934A

United States Patent [19]

Koshimizu

[11] Patent Number: 5,905,934

[45] Date of Patent: May 18, 1999

[54] SHEET CURL CONTROL DEVICE FOR A DUPLEX COPIER

[75] Inventor: Yoshiyuki Koshimizu, Abiko, Japan

[73] Assignee: Canon Kabushiki Kaisha, Tokyo, Japan

[21] Appl. No.: 08/856,173

[22] Filed: May 14, 1997

[30] Foreign Application Priority Data

May 16, 1996 [JP] Japan ..... 8-121623

[51] Int. Cl.[6] ..... G03G 15/00

[52] U.S. Cl. ..... 399/396; 271/161; 399/401; 399/406

[58] Field of Search ..... 399/396, 401, 399/402, 406; 271/161, 188, 209

[56] References Cited

U.S. PATENT DOCUMENTS

| | | | |
|---|---|---|---|
| 4,568,169 | 2/1986 | Wada et al. | 399/401 |
| 5,086,320 | 2/1992 | Koike | 399/401 |
| 5,270,778 | 12/1993 | Wyer | 399/406 |
| 5,307,133 | 4/1994 | Koshimizu et al. | 399/329 X |
| 5,515,152 | 5/1996 | Kuo | 399/406 |
| 5,572,308 | 11/1996 | Suda et al. | 399/401 |

FOREIGN PATENT DOCUMENTS

| | | |
|---|---|---|
| 56-108641 | 6/1984 | Japan . |
| 63-66036 | 3/1988 | Japan . |
| 3-267255 | 11/1991 | Japan . |

OTHER PUBLICATIONS

European Patent Office Communication and European Search Report.

*Primary Examiner*—William Royer
*Attorney, Agent, or Firm*—Fitzpatrick, Cella, Harper & Scinto

[57] ABSTRACT

An apparatus has a first conveyor for conveying a recording medium into an image forming unit which forms an image on a recording medium, a second conveyor for re-conveying the recording medium having an image formed thereon by the image forming unit to the second conveyor, and a curl straightener, formed by a plurality of rollers forming a bent path within the second conveyor, for straightening the curl on the recording medium. The conveyance speed of the second conveyor is switchable between a first speed equal to the conveyance speed of the first conveyor and a second speed which is greater than the first speed. The first speed is the speed of the recording medium until at least a predetermined length of the recording medium passes the curl straightener, and the second speed is the speed of the recording medium after passage therethrough. When image formation is performed in either two-side image forming mode of multiplex mode, it is possible to increase productivity during image formation by allowing the recording medium with the image to take a sufficient time to pass the curl straightener and thereafter re-conveying the recording medium at a higher speed to the image forming section.

17 Claims, 2 Drawing Sheets

SHEET CURL CONTROL DEVICE FOR A DUPLEX COPIER

BACKGROUND OF THE INVENTION

1. Field of the Invention

The present invention relates to an image forming apparatus for forming an image on both sides of a recording medium or an image on one side of a recording medium in a multiplex fashion, and, more particularly, to an image forming apparatus for forming an image on both sides or in a multiplex fashion, which is capable of properly straightening curls of a recording medium and increasing the image processing speed.

2. Description of the Related Art

Hitherto, an image forming apparatus capable of automatically forming an image on both sides of a recording medium has been provided. In such an apparatus, after image formation on one side of a recording medium, such as paper, the recording medium is sent once again to the front of the image forming section where an image is formed on the reverse side, followed by discharge of the recording medium with images formed on both sides. In the construction of many of these apparatuses, the recording medium, after fixing, is bent about 90 degrees from the horizontal in the vertical direction, and then further bent by about another 90 degrees from the vertical to the horizontal direction. Since the recording medium, which is still hot immediately after fixing, is conveyed through a bent path, the recording medium ordinarily curls downward, that is, the recording medium is curled with the image on one side thereof facing outward. Such a curl becomes a great obstacle when conveying and loading the recording medium onto an intermediate tray. Therefore, the recording medium is, ordinarily, made to pass through a section which functions to straighten the curl.

In recent years, however, there has been an increasing demand for higher productivity during image formation on both sides of a recording medium. In such a situation, an increase in the performance speed of the image forming sections, namely the optical system, the developing system, and fixing system, must be achieved by implementing better materials and component parts, thereby increasing apparatus costs. Accordingly, to increase productivity during image formation on both sides of a recording medium, the sheet feed speed at the two-side image forming section that is not related to the image-forming section, that is, the section which conveys the recording medium to the sheet feed section after the recording medium has left the fixing device, is made greater than the sheet feed speed at the image forming section.

In such a case, however, the recording medium is ordinarily conveyed at a greater speed at the section capable of straightening curls than at the image forming section. In general, curl is more effectively straightened, when the recording medium takes a longer time to pass the section capable of straightening curl. Accordingly, since the recording medium takes only a short time to pass the curl straightening section, the amount of curling is excessive. As a result, jamming or oblique movement occurs when the recording medium is being loaded onto the intermediate tray or being conveyed.

SUMMARY OF THE INVENTION

Accordingly, an object of the present invention is to make it possible to effectively straighten the curl of the recording medium so as not to hinder loading and conveying of the recording medium, even when the conveyance speed other than that realized at the image forming section is increased, in order to increase productivity during image formation on both sides of a recording medium.

To this end, according to a first form of the present invention, there is provided an image forming apparatus comprising an image forming section for forming an image onto a recording medium, a first conveying section for conveying the recording medium in said image forming section; second conveying sections for re-conveying the recording medium having an image formed thereon by said image forming section to said image forming section in either a two-side image forming mode or a multiplex mode, and curl straightening means disposed midway between said second conveying sections and formed by a group of a pair of rollers forming a bent conveyance path. Also, the conveyance speed of the second conveying section is switchable between a first speed which is equal to the conveyance speed of the first conveying section and a second speed which is greater than the first speed. The first speed is defined as the speed of the recording medium until at least a predetermined length of the recording medium passes the curl straightening means and the second speed being defined as the speed of the recording medium after passage through the curl straightening means.

According to a second form of the invention, the image forming apparatus of the first form further comprises a third conveying section which discharges the recording medium having an image formed thereon in normal mode, and a fourth conveying section which permits conveyance of the recording medium from an intermediate tray to the image forming section. In addition, the second conveying section is switchable, at a portion interfacing with the first conveying section, to the third conveying section and permits conveyance of the recording medium to the intermediate tray.

According to a third form of the present invention, in the image forming apparatus of the first form or the second form, when image formation is performed in the two-side image forming mode, the conveyance speed of the second conveying section is set at the first speed until the entire length of the recording medium passes the curl straightening means. Further the image formation is performed in the multiplex mode, the conveyance speed of the second conveying section is set at the first speed until the leading end of the recording material passes the curl straightening means by a predetermined distance.

According to a fourth form of the present invention, there is provided an image forming apparatus comprising an image forming section for forming an image on a recording medium, a first conveying section for conveying the recording medium in said image forming section, second conveying sections for reconveying the recording medium having an image formed thereon by the image forming section to the image forming section in either a two-side image forming mode or a multiplex mode; and curl straightening means disposed midway between the second conveying sections and formed by a group of a pair of rollers forming a bent conveyance path. The conveyance speed of the second conveying section is switchable to a first speed which is the same speed as the feed speed of the first conveying section, a second speed which is less than the first speed, and a third speed which is greater than the first speed. The second speed is defined as the speed of the recording medium until the leading end of the recording medium passes the curl straightening means by a predetermined distance, and the third speed is defined as the speed of the recording medium after passage through the curl straightening means.

In a fifth form of the present invention, in the image forming apparatus of the fourth form, when image formation is performed in the two-side image forming mode, the conveyance speed of the second conveying section is set at the second speed until the entire length of the recording medium passes the curl straightening means. Moreover when the image formation is performed in the multiplex mode, the conveyance speed of the second conveying section is set at the second speed until the leading end of the recording medium passes the curl straightening means by a predetermined distance.

According to a sixth form of the present invention, there is provided an image forming apparatus comprising an image forming section for forming an image on a recording medium, a first conveying section for conveying the recording medium in the image forming section, second conveying sections for reconveying the recording medium having an image formed thereon by the image forming section to the image forming section in either a two-side image forming mode or a multiplex mode, and curl straightening means disposed midway between the second conveying sections and formed by a group of a pair of rollers forming a bent conveyance path. The conveyance speed of the second conveying section, disposed upstream from the curl straightening means, is set at a first speed which is equal to the conveyance speed of the first conveying section. The conveyance speed of the second conveying section, located downstream from the curl straightening means, is set at a second speed which is greater than the first speed, so that the recording medium entering the downstream conveying section is conveyed at the second speed.

According to a seventh form of the present invention, the image forming apparatus of the sixth form further comprises a first-speed drive means for driving at the first speed with a one-way clutch the conveying means of the second conveying section located upstream from the curl straightening means, and a second-speed drive means for driving at the second speed the conveying means of the second conveying section located downstream from the curl straightening means by the predetermined distance.

According to an eighth form of the present invention, in the image forming apparatus of the first form, the curl straightening means comprises a resilient roller, and a hard roller, with the resilient roller being pressed into by the hard roller.

According to a ninth form of the present invention, in the image forming apparatus of the first form, the curl straightening means comprises a resilient roller and a plurality of hard rollers that contact the outside of the resilient roller.

DESCRIPTION OF THE PREFERRED EMBODIMENTS

Embodiment 1

There are image forming apparatuses, such as copying machines, printers, and facsimiles, which operate in a multiplex mode and in a two-side image forming mode. In the multiplex mode, image formation is performed a plurality of times on one sheet or on the same side of a recording medium. In the two-side image forming mode, image formation is performed on both sides of a sheet.

Upon completion of the first image forming operation, the sheet, subjected to image formation in the multiplex mode or the two-side image forming mode, is temporarily loaded on an intermediate tray (loading means for re-feeding) disposed in the body of the image forming apparatus, and then re-fed to the image forming section from the intermediate tray. In this case, upon completion of the first image forming operation in the multiplex mode, the sheet is loaded onto the intermediate tray, with the image forming side facing downward. Upon completion of the first image forming operation in the two-side image forming mode, the sheet is loaded onto the intermediate tray, with the image forming side facing upward.

A description will now be given of the entire structure of the image forming apparatus (copying machine) capable of operating in both the multiplex mode and the two-side image forming mode.

Figure 1:
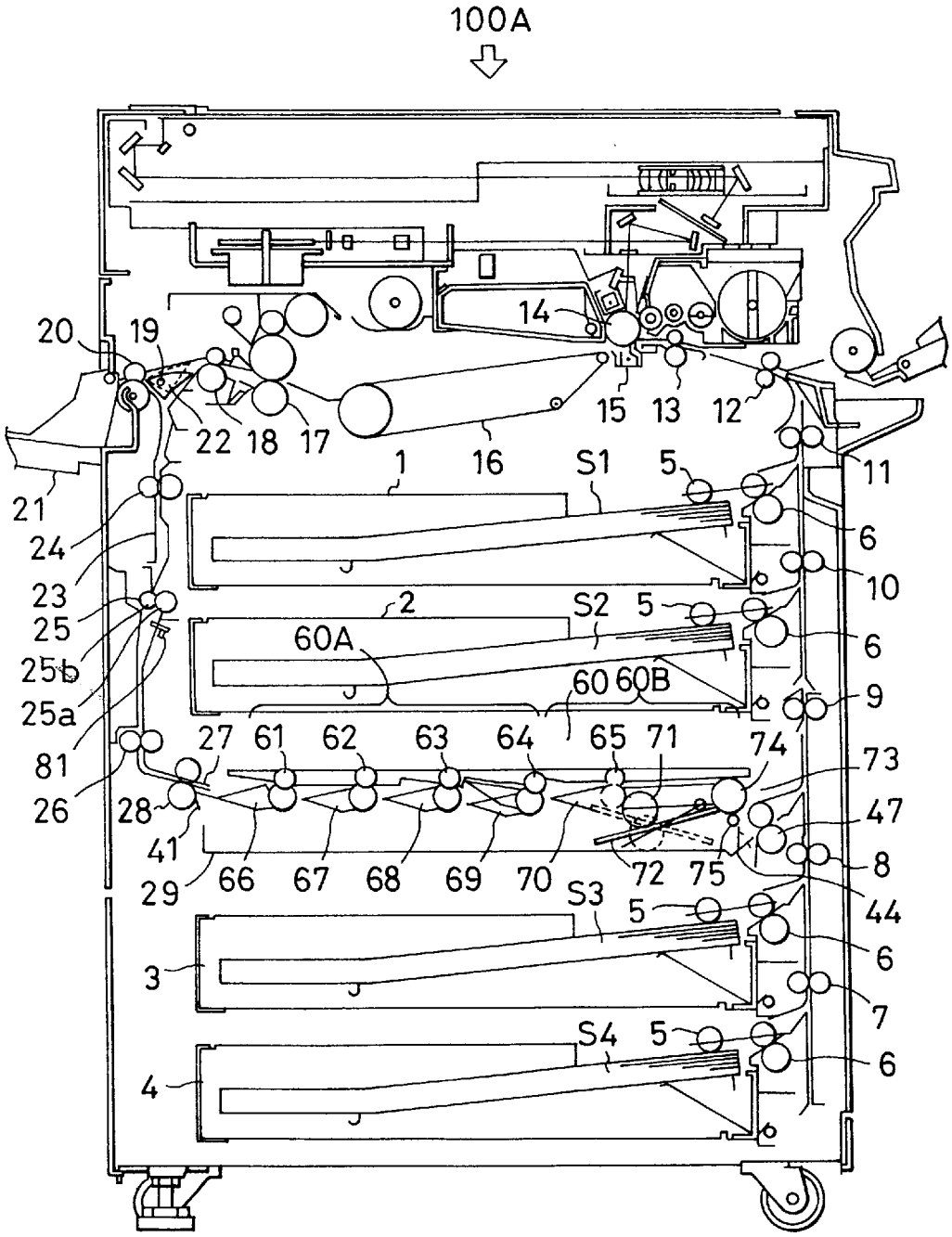
FIG. 1 is a sectional view of the entire structure of an image forming apparatus of Embodiment 1 in accordance with the present invention.

The structure of the image forming apparatus is shown in FIG. 1. The entire structure will be described by describing the sheet flow.

The image forming apparatus 100A has a plurality of front loading sheet feed cassettes 1 to 4. Each of the sheet feed cassettes 1 to 4 contain sheets S1 to S4 of different sizes, respectively. For example, the cassette 1 contains the sheet S1 of A5 size or statement size. The cassette 2 contains the sheet S1 of A4 size or B5 size or letter size. The cassette 3 contains the sheet S3 of A4R size or B5R size or letter R size. The cassette 4 contains the sheet S4 of B4 size or legal size.

In the image forming apparatus 100A, the sheets S1 to S4 in the sheet feed cassettes 1 to 4 are selectively fed. In FIG. 1, each sheet feed roller 5 rotates counterclockwise in order to successively feed its associated sheet S1 to sheet S4 contained in each of the sheet feed cassettes 1 to 4, starting from the topmost sheet. Each of a pair of separating rollers 6 separates only the topmost sheet S fed by its associated sheet feed roller 5, after which the separated sheet is sent to a pair of register rollers 13 in a non-rotating state through each of a pair of conveyor rollers 7 to 12.

The pair of conveyor rollers 7 to 12 continue conveying the sheet S until an end of the sheet S strikes a nip portion of the pair of register rollers 13 and forms a predetermined amount of loop. The oblique movement of the sheet S is corrected by formation of this loop.

After the oblique movement has been corrected, the sheet S is sent to a transfer section between a photosensitive drum 14 and a transfer charger 15 by the pair of register rollers 13 which start rotating based on a timing in which a toner image on the photosensitive drum 14, such as an electrophotographic photosensitive member, rotating clockwise in the figure and the sheet end come into alignment. During passage of the sheet S through the transfer section, the toner image on the photosensitive drum 14 is transferred successively onto the sheet surface by the transfer charger 15.

After transfer of the toner image, the sheet S is sent to a pair of fixing rollers 17 through a conveyor belt 16. Then, the sheet is heated and subjected to pressure as it passes between the nip portion of the pair of fixing rollers 17, causing the transferred toner image to be fixed onto the sheet surface.

In normal mode, after fixing of the toner image, the sheet S, conveyed by the pair of conveyor rollers 18, passes through a discharge path 19 to a pair of discharge rollers 20 that discharge the sheet S onto a discharge tray 21 outside the image forming apparatus. In normal mode, a flapper 22 opens the discharge path 19 as indicated by the solid line, and closes a vertical path 23.

In the case of multiplex mode and two-side image forming mode, after fixing of the toner image, the sheet S, conveyed by the conveyor rollers 18, are sent through the vertical path 23 which leads to an intermediate tray 29. In this case, the flapper 22 closes the discharge path 19 as indicated by the dotted lines, and opens the vertical path 23.

The sheet S is conveyed by a pair of conveyor rollers 24 in the vertical path to a pair of curl straightening rollers 25. The pair of curl straightening rollers 25 are formed by a resilient roller, such as a soft roller 25*a*, and a hard roller, such as a hard roller 25*b*. The soft roller contacts the lower surface of the sheet S and is made of urethane-type foaming agent, while the hard roller contacts the upper surface of the sheet S and is made of, for example, materials containing iron, or aluminum, or resin.

Figure 2:
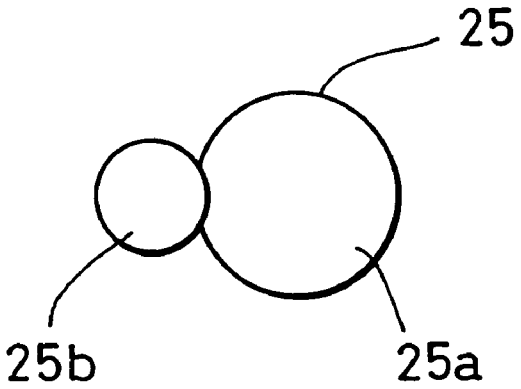
FIG. 2 is a sectional view of the curl straightening means in Embodiment 1 in accordance with the present invention.

As shown in FIG. 2, the axial distance between the soft roller 25*a* and the hard roller 25*b* is smaller than the total sum of the radii of the two rollers. The soft roller 25*a* is pushed inward by the hard roller 25*b*, thereby decreasing the outer diameter or the outer periphery of the soft roller 25*a*. The sheet S passes between a path shown in FIG. 2, so that the sheet S with its left side curled prior to entry between the pair of rollers 25 is straightened by curling the sheet S toward the right in the nip portion of the pair of rollers 25.

In the multiplex mode, the sheet S, conveyed through the vertical path 23, is sent into a path 27 by the pair of conveyor rollers 24 to 26, and then to a discharge path 60 located above the intermediate tray 29 by means of a pair of rollers 28. Thereafter, the sheet S is discharged above the intermediate tray 29 with the surface with the image facing downward from any one of a pair of discharge rollers 61 to 64 disposed in the sheet conveyance direction of the discharge path 60.

When a sheet S with the maximum size in the conveyance direction is being used, a first flapper 66 rotates upward to discharge the sheet S from a discharge opening 41. When a sheet S with the next largest size is being used, a second flapper 67 rotates upward to discharge the sheet S from the first pair of discharge rollers 61. When a sheet S with the third largest size is being used, a third flapper 68 rotates upward to discharge the sheet S from the second pair of discharge rollers 62. When a sheet S with the fourth largest size is being used, a fourth flapper 69 rotates upward to discharge the sheet S from the third pair of discharge rollers 63. When a sheet S with the smallest size is being used, a fifth flapper 70 rotates upward to discharge the sheet S from the fourth pair of discharge rollers 64.

The sheet S, discharged onto the intermediate tray 29, is conveyed by an auxiliary roller 71 rotating counterclockwise in the figure, until an end of the sheet S contacts an erect rotary shutter 44. Here, the end of the sheet is guided by a movable sheet guide 72 in an inclined state as indicated by the dotted lines in the figure, so that curling can be kept down to a minimum. The auxiliary roller 71 waits at a position indicated by the solid lines in the figure during discharging of the sheet, and moves downward to a position indicated by the dotted lines in the figure immediately after sheet discharge. An opening is formed in the movable sheet guide 72 to permit vertical movement of the auxiliary roller 71.

The sheets S on the intermediate tray are successively supplied, starting from the topmost sheet, by the auxiliary roller 71 rotating counterclockwise in the figure. Here, the auxiliary roller 71 moves downward from the waiting position indicated by the solid lines to the position indicated by the dotted lines in order to supply the sheets S. The movable shutter 44 guides the obliquely supplied sheet S to a nip section of a pair of separating rollers 47.

Only the topmost sheet of the sheets S supplied by the auxiliary roller 71 is separated by the pair of separating rollers 47 and sent to the pair of register rollers 13 in a non-rotating state through the pairs of conveyor rollers 9 to 12.

In the two-side image forming mode, the sheets S, sent to the vertical path 23, are conveyed to the path 27 by the pair of conveyor rollers 24 to 26, and then to the discharge path 60 by means of the pair of rollers 28. In the two-side image forming mode, all of the flappers 66 to 70 in the discharge path 60 rotate downward. The sheets S, conveyed through the discharge path 60, are conveyed to an end side U-turn section 73 by any one of the pairs of discharge rollers 61 to 65, and discharged onto the intermediate tray 29 with the surface with the formed image facing upward by the discharge roller 74 and a discharge roller 75. Here, the ends of the sheets S are guided by the movable sheet guide 72 set in an inclined state as indicated by the solid lines, so that curling can be controlled.

The sheets S, discharged onto the intermediate tray 29, are conveyed by the auxiliary roller 71 rotating counterclockwise in the figure, until an end of each sheet (trailing end of sheet during discharge) contacts the erect movable shutter 44. Here, each end of each sheet is guided by the movable sheet guide 72 set in an inclined state as shown by the dotted lines in the figure in order to control curling. The auxiliary roller 71 waits at a position indicated by the solid lines during sheet discharge, and moves downward to a position indicated by the dotted lines immediately after sheet discharge to convey the sheets S.

As with the multiplex mode, the sheets S on the intermediate tray 29 are successively re-fed by the auxiliary roller 71, starting from the topmost sheet.

In the discharge path 60 in the present embodiment, area 60A is a multiplex mode discharge section including the pairs of discharge rollers 61 to 64, and area 60B disposed downstream from the area 60A is a two-side image forming mode discharge section.

In the present embodiment, when the sheets S are being fed between the pair of fixing rollers 17 and the pair of conveyor rollers 18 during the sheet flow, the sheets S are fed at a speed of 200 mm/sec by the main motor at the body side in correspondence with the speed during image formation. From the pair of rollers 24 in the vertical path to the pairs of rollers above the intermediate tray 29, the sheets S are conveyed by a different intermediate tray motor (not shown). The sheet feeding speed of the intermediate tray motor can be switched between 200 mm/sec, which is equal to the feeding speed at the image forming section, and twice that speed, or 400 mm/sec.

The sheet S with an image formed on one side passes through the pair of conveyor rollers 18 rotating at 200 mm/sec, and then passes through the pair of vertical path rollers 24. The sheet S is then sent between the pair of curl straightening rollers 25, which straightens the curl on the sheet S. A vertical path sensor 81 located right below the pair of rollers 25 in FIG. 1 detects that the trailing end of the sheet S has left the pair of vertical path rollers 25. Based on the timing in which the trailing end leaves the rollers 25, the feeding speed of the intermediate tray motor switches from 200 mm/sec to 400 mm/sec. Thereafter, the sheet S is fed at 400 mm/sec and loaded on the intermediate tray 29.

By virtue of the above-described operations and structure, when the sheet is always conveyed between the pair of curl straightening rollers at about the same speed as when it is conveyed through the image forming section, it is possible to take full advantage of the curl straightening effect. After leaving the pair of curl straightening rollers, the sheet is fed at twice that speed in order to increase productivity.

Embodiment 2

In the present embodiment, the aforementioned pairs of rollers 24, 25, and 26 in the vertical path are driven by a motor designed specially for these pairs of rollers and capable of switching the feeding speeds between 200 mm/sec and 400 mm/sec. From the pair of rollers 28 and onwards, the sheet is constantly fed at 400 mm/sec by the intermediate tray motor.

When such a structure is used, the feeding speed can be set freely at any value from the time the trailing end of the sheet leaves the pairs of rollers of the image forming sections until the time it reaches the pairs of rollers at the intermediate tray section.

When the trailing end of the sheet is between the pair of rollers 18, the vertical path section is driven at 200 mm/sec. Immediately after the trailing end of the sheet leaves the pair of rollers 18, the sheet feed speed is dropped down to 100 mm/sec in order to take full advantage of the curl straightening effect. Immediately after the trailing end of the sheet leaves the pair of rollers 25, the sheet feed speed is increased to 400 mm/sec, and the leading end of the sheet is conveyed to the first pair of rollers 28 at the intermediate tray. In order to receive the next sheet immediately after the trailing end of the sheet has left the last roller 26 in the vertical path, the sheet feed speed is decreased back to 200 mm/sec. By repeating the above-described operations, curl straightening becomes more effective and productivity of image formation on both sides of a recording medium can be increased.

It is to be noted that the sheet S does not have to be conveyed at a constant speed as it is passing the pair of curl straightening rollers 25. For example, when the primary purpose is to straighten the curl on the leading end of the sheet so that loading of the sheet onto the intermediate tray is not hindered, the conveyance speed can be increased after the front end of the sheet S has passed through the pair of curl straightening rollers 25 by a predetermined distance in order to increase productivity. The speed settings may be set by the user.

When there is a large curl on the leading end of the sheet S during the second image forming operation, poor image transfer and poor separation from the photosensitive drum result during the second image forming operation. Therefore, in the two-side image forming mode, since the trailing end of the sheet in the first image forming operation becomes the leading end in the second image forming operation, the sheet S is conveyed at a lower speed until the entire length of the sheet passes the curl straightening section. In the multiplex mode, since the leading end of the sheet in the first image forming operation is also the leading end in the second image forming operation, the conveyance may be speeded up to increase productivity immediately after the leading end of the sheet has passed the curl straightening section by a predetermined distance.

Embodiment 3

A description will now be given of an embodiment which can be more easily carried out at a lower cost compared to the previous embodiment.

Unlike the previous embodiment, when the apparatus is in operation, the pair of rollers 24 and the pair of curl straightening rollers 25 in the vertical path are constantly driven at 200 mm/sec by the main motor at the body side. The pair of rollers 24 and the pair of curl straightening rollers 25 are provided with a one-way clutch. The pair of rollers 26 and the rollers which follow are constantly driven at 400 mm/sec by the intermediate tray motor.

The leading end of the conveyed sheet S passes between the pair of curl straightening rollers 25 at 200 mm/sec to the pair of rollers 26. Since the pair of rollers 26 are driven at 400 mm/sec, the sheet S is fed at 400 mm/sec, so that the pair of rollers 24 or 25 nip the trailing end of the sheet S rotate idly by the one-way clutch.

In this case, in the region between the pairs of rollers 25 and 26, the leading end of the sheet S is always conveyed at 200 mm/sec by the pair of curl straightening rollers 25. Therefore, the curl at the leading end of the sheet, the straightening of which is important for proper loading onto the intermediate tray, is sufficiently straightened.

According to the present embodiment, it is not necessary to use a drive source for switching between sheet feed speeds, the curl can be straightened at a lower cost, and the productivity can be increased.

Although in the foregoing description, the sheet feed speeds have been described as being 200 mm/sec and 400 mm/sec for convenience, these speeds are just one example, so that the present invention is obviously not limited to these speed values.

Figure 3:
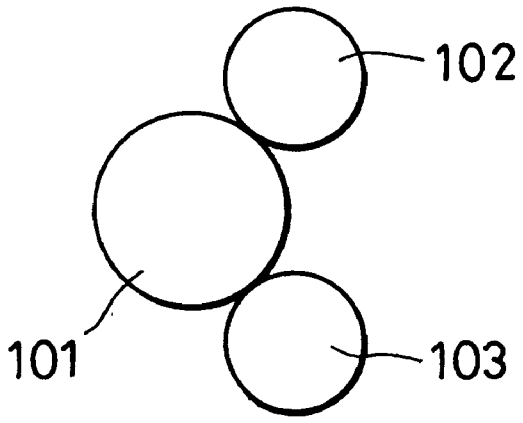
FIG. 3 is a sectional view of another embodiment of a curl straightening means in accordance with the present invention.

Although in the foregoing description, the curl straightening roller has been described as being formed by a pair of soft roller made of urethane-type foaming agent and an iron-type hard roller, the present invention is not limited thereto. For example, as shown in FIG. 3, the curl straightening roller may be formed by a resilient, solid rubber roller 101, and a combination of at least two hard rollers 102 and 103 made of material containing iron, aluminum, or resin. Straightening may be performed by curling the recording medium toward the right as with the rollers in FIG. 2.

As can be understood from the foregoing description, according to the present invention, in the case of image formation in the two-side image forming mode or multiplex mode, it is possible to take full advantage of the curl straightening effect by setting the conveyance speed at the conveyance section which re-feeds the recording medium to the image forming section after a first image forming operation to a value equal to or less than the conveyance speed at the image forming section, when the recording medium passes the curl straightening means. After the sheet has passed the curl straightening means, the speed at the re-feeding conveyance section is increased to permit increased productivity during image formation.

Although in the foregoing description, the conveyance speed is increased after passage of either the trailing end or leading end of the sheet S through the curl straightening means, the present invention is not limited thereto. The conveyance speed may be increased when a portion of the recording medium requiring straightening passes through the curl straightening means, or at a time other than when the portion requiring straightening passes through the curl straightening means.

For example, in both-side image formation mode, the leading end and the trailing end of the sheet S after passage through the curl straightening means is reversed, thus making it necessary for the curl straightening means to, in particular, straighten curls at the trailing end of the sheet S.

In such a case, the recording medium may be conveyed at a high speed when the leading end of the sheet passes the curl straightening means in order to increase productivity, and at a lower speed when the trailing end of the sheet passes the curl straightening means.

In addition, in the foregoing description, the pair of rollers 24 and the final pair of rollers 26 in the vertical path may be driven at a speed equal to or greater than the speed during image formation, followed by a decrease in the conveyance speed only when a predetermined portion of the sheet is passing through the curl straightening means, and then an increase in the conveyance speed to the initial high speed after the predetermined portion of the sheet has passed the curl straightening means.

What is claimed is:

1. An image forming apparatus operable in at least one of a normal mode, a multiplex mode and a two-side image forming mode, comprising:

an image forming means for forming an image onto a recording medium;

first conveying means for conveying the recording medium through said image forming means;

second conveying means for re-conveying the recording medium having an image formed thereon by said image forming means to said first conveying means in one of the two-side image forming mode and the multiplex mode; and curl straightening means disposed within said second conveying means and formed by a plurality of rollers forming a bent conveyance path;

wherein a conveyance speed of said second conveying means is switchable between a first speed which is equal to a conveyance speed of said first conveying means and a second speed which is greater than the first speed, the first speed being a speed of conveyance of the recording medium until at least a predetermined length of the recording medium passes said curl straightening means and the second speed being a speed of conveyance of the recording medium after passage through said curl straightening means.

2. An image forming apparatus according to claim 1, further comprising third conveying means downstream from said first conveying means which discharges the recording medium having an image formed thereon in normal mode, and fourth conveying means upstream from said first conveying means for conveying the recording medium from an intermediate tray to said first conveying means, wherein said second conveying means conveys the recording medium to the intermediate tray and is switchable, at a portion interfacing with said first conveying means, to said third conveying means.

3. An image forming apparatus according to claim 1 or claim 2, wherein in the two-side image forming mode, the conveyance speed of said second conveying means is set at the first speed until the entire length of the recording medium passes said curl straightening means, and wherein in the multiplex mode, the conveyance speed of said second conveying means is set at the first speed until the leading end of the recording material passes said curl straightening means by a predetermined distance.

4. An image forming apparatus according to claim 1, wherein said curl straightening means comprises a resilient roller, and a hard roller, said resilient roller being pressed into by said hard roller.

5. An image forming apparatus according to claim 1, wherein said curl straightening means comprises a resilient roller and a plurality of hard rollers that contact the outside of said resilient roller.

6. An image forming apparatus according to claim 1, wherein said curl straightening means comprises a resilient roller, and at least one hard roller, wherein the axial distance between said resilient roller and each of said at least one hard roller is smaller than the total sum of the radii of the two rollers.

7. An image forming apparatus operable in at least one of a normal mode, a multiplex mode and a two-side image forming mode, comprising:

an image forming means for forming an image on a recording medium;

first conveying means for conveying the recording medium through said image forming means;

second conveying means for re-conveying the recording medium having an image formed thereon by said image forming means in one of the two-side image forming mode and the multiplex mode; and curl straightening means disposed within said second conveying means and formed by a plurality of rollers forming a bent conveyance path;

wherein a conveyance speed of said second conveying means is switchable among a first speed which is the same speed as the feed speed of said first conveying means, a second speed which is less than the first speed, and a third speed which is greater than the first speed, the second speed being the speed of conveyance of the recording medium until the leading end passes said curl straightening means by a predetermined distance, and the third speed being the speed of conveyance of the recording medium after passage through said curl straightening means.

8. An image forming apparatus according to claim 7, wherein in the two-side image forming mode, the conveyance speed of said second conveying means is set at the second speed until the entire length of the recording medium passes said curl straightening means; and wherein in the multiplex mode, the conveyance speed of said second conveying means is set at the second speed until the leading end of the recording medium passes said curl straightening means by a predetermined distance.

9. An image forming apparatus operable in at least one of a normal mode, multiplex mode and a two-side image forming mode, comprising:

an image forming means for forming an image on a recording medium;

first conveying means for conveying the recording medium in said image forming means;

second conveying means for re-conveying the recording medium having an image formed thereon by said image forming means to said first conveying means in one of the two-side image forming mode and the multiplex mode; and curl straightening means disposed within said second conveying means and formed by a plurality of rollers forming a bent conveyance path;

wherein the conveyance speed of a portion of said second conveying means disposed upstream from said curl straightening means is set at a first speed which is equal to the conveyance speed of said first conveying means; and wherein the conveyance speed of a portion of said second conveying means located downstream from said curl straightening means for conveying a recording medium is set at a second speed which is greater than the first speed;

first-speed drive means for driving at the first speed with a one-way clutch the conveying means of said portion of second conveying means located upstream from said curl straightening means; and second-speed drive means for driving at the second speed the conveying means of said portion of second conveying means located downstream from said curl straightening means.

10. A sheet conveyor, comprising:

first conveying means for conveying a sheet at a first speed;

second conveying means, disposed downstream from said first conveying means in the conveying direction, for conveying the sheet at a second speed; and curl straightening means, disposed between said first conveying means and said second conveying means, for straightening a curl on the sheet while conveying the sheet;

wherein said curl straightening means conveys the sheet at a third speed which is less than the first speed or the second speed until at least a predetermined portion of the sheet passes said curl straightening means.

11. A sheet conveyor according to claim 10, wherein the first speed and the second speed are substantially equal.

12. A sheet conveyor according to claim 10, wherein the first speed and the third speed are substantially equal.

13. A sheet conveyor according to claim 10, wherein the third speed is less than the first speed and the second speed.

14. A sheet conveyor according to claim 10, wherein said curl straightening means conveys the sheet at the first speed when the sheet is passing said first conveying means; and wherein said curl straightening means conveys the sheet at the third speed after passage of the sheet through the first conveying means.

15. A sheet conveyor according to claim 10, wherein when said curl straightening means conveys the sheet at the third speed, one of said first conveying means and said second conveying means conveys the sheet at a speed substantially equal to the third speed.

16. A sheet conveyor according to claim 10, wherein when the sheet reaches said second conveying means, the sheet is conveyed at the second speed.

17. A sheet conveyor according to claim 10, further comprising image forming means for forming an image on the sheet, wherein said first conveying means conveys the sheet having the image formed thereon by said image forming means.

* * * * *

UNITED STATES PATENT AND TRADEMARK OFFICE

CERTIFICATE OF CORRECTION

PATENT NO. : 5,905,934

DATED : May 18, 1999

INVENTOR(S) : YOSHIYUKI KOSHIMIZU

It is certified that error appears in the above-identified patent and that said Letters Patent is hereby corrected as shown below:

COVER PAGE AT ITEM [56] FOREIGN PATENT DOCUMENTS,
"56-108641" should read --59-108641--.

COLUMN 2,
Line 41, "Further" should read --Further,--; and
Line 51, "said" should read --the--.

COLUMN 3,
Line 6, "Moreover" should read --Moreover,--.

COLUMN 8,
Line 32, "roller" should read --rollers--.

Signed and Sealed this

Ninth Day of November, 1999

*Attest:*

*Attesting Officer*

Q. TODD DICKINSON

*Acting Commissioner of Patents and Trademarks*